US012721451B2

(12) United States Patent
Burghoffer

(10) Patent No.: US 12,721,451 B2
(45) Date of Patent: Sep. 1, 2026

(54) MATTRESS COVER

(71) Applicant: DaVinci II CSJ, LLC, Fairfield, NJ (US)

(72) Inventor: James Burghoffer, Sparta, NJ (US)

(73) Assignee: DaVinci II CSJ, LLC, Fairfield, NJ (US)

( * ) Notice: Subject to any disclaimer, the term of this patent is extended or adjusted under 35 U.S.C. 154(b) by 0 days.

(21) Appl. No.: 18/893,717

(22) Filed: Sep. 23, 2024

(65) Prior Publication Data

US 2026/0083255 A1 Mar. 26, 2026

(51) Int. Cl.
*A47C 31/10* (2006.01)

(52) U.S. Cl.
CPC ..... *A47C 31/105* (2013.01)

(58) Field of Classification Search
CPC ..... A47C 31/10; A47C 31/105; A47C 27/002; A47G 9/0246
See application file for complete search history.

(56) References Cited

U.S. PATENT DOCUMENTS 4,937,904 A * 7/1990 Ross ..... A47G 9/0246 24/72.5
4,970,744 A * 11/1990 Davis ..... A47G 9/0246 5/497
5,046,207 A * 9/1991 Chamberlain ..... A47G 9/0246 5/497
5,208,927 A * 5/1993 Lachmar ..... A47G 9/02 5/923
8,856,984 B1 * 10/2014 Donham ..... A47G 9/0246 5/497
10,517,412 B1 * 12/2019 Nekhala ..... A47G 9/0246
10,610,034 B2 * 4/2020 Sturgeon ..... A47G 9/0292
2002/0116763 A1 * 8/2002 Weir ..... A47G 9/0246 5/504.1
2003/0019037 A1 * 1/2003 Michaelis ..... A47G 9/02 5/497
2008/0155749 A1 * 7/2008 Stevens ..... A47G 9/0246 5/496
2008/0289104 A1 * 11/2008 Rowson ..... A47G 9/02 5/923
2009/0106899 A1 * 4/2009 Wootten, Jr. ..... A47G 9/0246 5/497
2010/0088819 A1 * 4/2010 Carter ..... A47C 31/105 5/482
2011/0113550 A1 * 5/2011 Lafoux ..... A47G 9/086 5/413 R (Continued)

FOREIGN PATENT DOCUMENTS

CA 2645694 A1 * 6/2009 ..... A47C 27/005
FR 2631531 A1 * 11/1989 ..... A47C 27/008

(Continued)

*Primary Examiner* — David E Sosnowski
(74) *Attorney, Agent, or Firm* — Kelley Drye & Warren LLP

(57) ABSTRACT

A mattress cover configured to cover a mattress, including a fabric body, an elastic lining extending along an inner perimeter of the fabric body; and a cord housed within a lining and running along a portion of the inner perimeter of the fabric body; wherein the cord exits the lining via openings positioned at each corner of the fabric body, such that a portion of the cord is exposed across each corner of the fabric body.

16 Claims, 3 Drawing Sheets

(56) References Cited

U.S. PATENT DOCUMENTS

| | | | | |
|---|---|---|---|---|
| 2012/0324646 | A1* | 12/2012 | Briganti | A47G 9/0246 5/496 |
| 2016/0007774 | A1* | 1/2016 | Kakabeeke | A47G 9/0246 5/496 |
| 2016/0174738 | A1* | 6/2016 | Nekhala | A47G 9/04 24/72.5 |
| 2017/0035210 | A1* | 2/2017 | Nekhala | A47G 9/0246 |
| 2017/0251839 | A1* | 9/2017 | McLeod | A47G 9/0246 |
| 2017/0354276 | A1* | 12/2017 | Alletto, Jr. | A47G 9/0246 |
| 2018/0014666 | A1* | 1/2018 | Blazejewski | A47G 9/0246 |
| 2018/0303256 | A1* | 10/2018 | Sturgeon | A47C 21/022 |
| 2018/0360228 | A1* | 12/2018 | Johannessen | A47C 27/081 |
| 2021/0120964 | A1* | 4/2021 | Nekhala | A47C 21/022 |
| 2022/0330730 | A1* | 10/2022 | Hunter | A47G 9/0246 |
| 2023/0011381 | A1* | 1/2023 | Bledsoe | A47G 9/0246 |
| 2023/0240456 | A1* | 8/2023 | Nekhala | A47G 9/0238 5/497 |
| 2024/0225320 | A1* | 7/2024 | Nekhala | A47G 9/0246 |
| 2025/0120523 | A1* | 4/2025 | Tirk | A47G 9/0246 |

FOREIGN PATENT DOCUMENTS

| | | | | |
|---|---|---|---|---|
| KR | 20180000340 | U * | 2/2018 | A47C 31/007 |
| WO | WO-2010099614 | A1 * | 9/2010 | A47G 9/0246 |
| WO | WO-2013176540 | A1 * | 11/2013 | A47C 21/022 |

* cited by examiner

MATTRESS COVER

TECHNICAL FIELD

Aspects of the present disclosure generally relate to mattress covers, and more particularly, to a mattress cover with a cinching mechanism.

BACKGROUND

Reference may be made herein to other United States patents, foreign patents, and/or other technical references. Any reference made herein to other documents is an express incorporation by reference of the document so referenced in its entirety.

The bedding industry has seen significant growth and diversification, with increasing emphasis on enhancing comfort, hygiene, and convenience in sleep products. Among these, mattress covers play a critical role in protecting mattresses from dust, allergens, spills, and wear, thereby extending the lifespan of the mattress and maintaining cleanliness. Despite their importance, many traditional mattress covers struggle to provide a consistently secure fit, especially with the wide variety of mattress sizes and thicknesses available in the market today. As consumer expectations for durability and convenience rise, the need for more innovative solutions in mattress cover design has become apparent.

Traditional mattress covers typically rely on elastic bands sewn along the fabric's perimeter to hold the cover in place over a mattress. While this method offers some degree of flexibility, it is often insufficient for securing the cover, particularly on thicker or non-standard-sized mattresses. The limitations of elastic bands are more evident when in use, as conventional covers easily shift or come loose from the mattress with movement. This not only causes discomfort but also diminishes the cover's effectiveness in protecting the mattress. The common occurrence of mattress covers slipping off at the corners or bunching up underscores the need for more effective cover fastening mechanisms.

The problem is exacerbated by the increasing popularity of mattresses with greater depth, such as pillow-top and memory foam varieties, which are often paired with additional mattress toppers for enhanced comfort. These thicker mattresses challenge the capabilities of standard elastic bands, which may lack the necessary tension to secure the cover adequately. As a result, many users find themselves frequently readjusting the cover, leading to frustration and inconvenience. Additionally, the inconsistent fit can lead to uneven protection and increased wear and tear on both the mattress and the cover.

In response to these issues, various design modifications have been attempted. Some manufacturers have opted for deeper pockets or stronger, wider elastic bands to accommodate thicker mattresses. While these adjustments can improve fit to some extent, they often come at a higher cost and do not fully address the problem of maintaining a secure, stable fit. Other approaches, such as incorporating clips, straps, or additional securing devices, have also been explored. However, these solutions can complicate the use of the mattress cover, making it more cumbersome to fit and remove, and may not offer sufficient flexibility for different mattress sizes and shapes.

Furthermore, the aesthetic and practical demands of consumers have led to the development of specialized mattress covers, including hypoallergenic options, waterproof variants, and covers made from natural or eco-friendly materials. These specialized covers often require more precise fitting mechanisms to ensure they remain effective in their protective roles. For instance, hypoallergenic covers must fit snugly to prevent allergens from penetrating the cover, while waterproof covers need to maintain a tight seal to prevent liquids from reaching the mattress. The increasing complexity and specialization of mattress covers further highlight the inadequacies of traditional elastic band solutions.

As the bedding market continues to evolve, there is a growing recognition of the need for mattress covers that not only offer protection and comfort but also provide a reliable and adaptable fit. The limitations of current designs underscore the necessity for innovative approaches that address the common issues of cover displacement and insufficient securing mechanisms.

SUMMARY

Techniques described herein are directed to a mattress cover with a cinching mechanism.

In one embodiment, a mattress cover configured to cover a mattress, is disclosed, comprising: a fabric body; an elastic lining extending along an inner perimeter of the fabric body; and a cord housed within a lining and running along a portion of the inner perimeter of the fabric body; wherein the cord exits the lining via openings positioned at each corner of the fabric body, such that a portion of the cord is exposed across each corner of the fabric body.

In one embodiment, the cord traverses each corner diagonally when exposed from the openings.

In one embodiment, the cord is configured to be tightened to adjust tension around the inner perimeter of the mattress cover.

In one embodiment, the openings comprise first openings and second openings, and the lining terminates at each of the first openings and each of the second openings at each corner of the fabric body.

In one embodiment, the cord exits the lining via each of the first openings and enters the lining via each of the second openings.

In one embodiment, a spacing between each of the first openings and each of the second openings determines a length of the exposed portion of the cord across each corner of the fabric body.

In one embodiment, each of the first openings and each of the second openings are positioned to create an approximately 45-degree angle for the cord across each corner of the fabric body.

In one embodiment, each of the first openings is positioned at a first distance from each corner of the fabric body, each of the second openings is positioned at a second distance from each corner of the fabric body, and the first distance is different from the second distance.

In one embodiment, each of the first openings and each of the second openings are reinforced with eyelets.

In one embodiment, the eyelets are composed of metal or plastic.

In one embodiment, the cord is composed of a flexible, durable material selected from the group consisting of nylon, polyester, and an elastic polymer.

In one embodiment, the elastic lining is configured to provide initial tension around the inner perimeter of the fabric body.

In one embodiment, the mattress cover further includes a cinching mechanism configured to tighten the cord around the inner perimeter of the mattress cover.

In one embodiment, the cinching mechanism includes a cord lock or a friction-based clamp.

In one embodiment, the cord forms a continuous loop around the inner perimeter of the mattress cover.

In one embodiment, the cord passes from the lining through a first intermediate opening, passes through the cinching mechanism, and re-enters the lining through a second intermediate opening.

In one embodiment, the cinching mechanism is configured to lock the cord in a tightened position.

In one embodiment, the cord comprises two free ends threaded through a cinch at a straight edge of the lining.

In one embodiment, each of the free ends comprises a cord end clasp configured to prevent each of the free ends from passing through the cinch.

In one embodiment, the inner lining comprises a single-channel inner lining.

The above summary has outlined, rather broadly, some features and technical advantages of the present disclosure in order that the detailed description that follows may be better understood. Additional features and advantages of the disclosure will be described below. It should be appreciated by those skilled in the art that this disclosure may be readily utilized as a basis for modifying or designing other systems and structures for carrying out the same or similar purposes of the present disclosure. It should also be realized by those skilled in the art that such equivalent constructions do not depart from the teachings of the disclosure as set forth in the appended claims. The novel features, which are believed to be characteristic of the disclosure, both as to its organization and method of operation, together with further features and advantages, will be better understood from the following description when considered in connection with the accompanying figures. It is to be expressly understood, however, that each of the figures is provided for the purpose of illustration and description only and is not intended as a definition of the limits of the present disclosure.

BRIEF DESCRIPTION OF THE DRAWINGS

The features, nature, and advantages of the present disclosure will become more apparent from the detailed description set forth below when taken in conjunction with the drawings, in which.

DETAILED DESCRIPTION

The detailed description set forth below, in connection with the appended drawings, is intended as a description of various configurations and is not intended to represent the only configurations in which the concepts described herein may be practiced. The detailed description includes specific details for the purpose of providing a thorough understanding of the various concepts. It will be apparent, however, to those skilled in the art that these concepts may be practiced without these specific details. In some instances, well-known features may be omitted or simplified in order not to obscure the embodiment being described.

Figure 1:
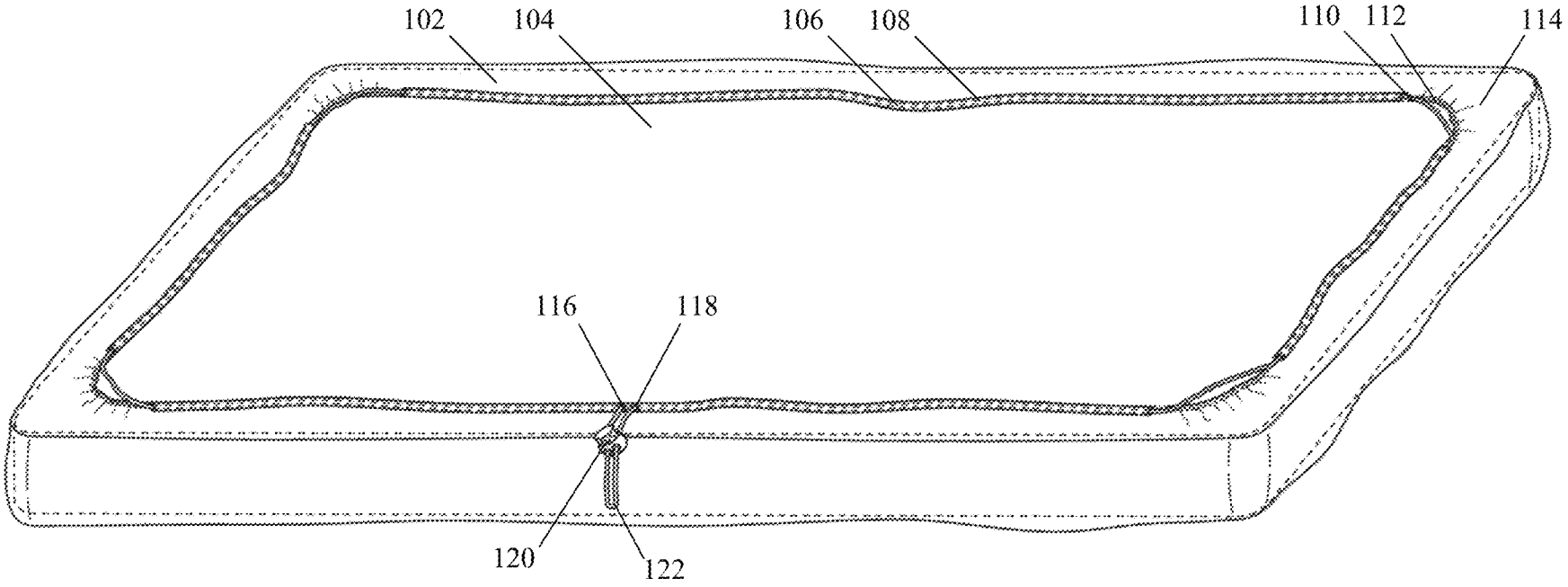
FIG. 1 depicts an illustrative mattress cover in an uncinched configuration according to an embodiment of the present disclosure.

FIG. 1 depicts an illustrative mattress cover in an uncinched configuration according to an embodiment of the present disclosure. Mattress cover 102 is configured to cover the top, sides, and portions of the bottom of mattress 104, providing full coverage and protection. Mattress cover 102 may be composed of a flexible, durable material, such as cotton, polyester, or microfiber, suitable for repeated use and washing, and is designed to fit various mattress sizes and depths, conforming to the mattress shape.

Single-channel lining 106 runs along a majority of the inner perimeter of mattress cover 102, housing both cord 108 and elastic lining 112. Single-channel lining 106 may be stitched securely into mattress cover 102, allowing cord 108 to move freely within. For additional durability, single-channel lining 106 may be constructed with a same or similar material as mattress cover 102, and may include reinforced edges to prevent fraying and ensure long-term durability. Alternatively, single-channel lining 106 may be composed of a smoother material, such as nylon, to reduce friction and facilitate easier adjustment of cord 108.

Cord 108 is configured to run within single-channel lining 106 and provide adjustable tension around the perimeter of mattress cover 102. Cord 108 may be composed of strong, flexible materials like nylon or polyester, allowing cord 108 to be repeatably tightened or loosened as needed and durable enough to withstand continuous use. Elastic lining 112, parallel to cord 108 and running along an inner perimeter of mattress cover 102, provides initial tension, helping mattress cover 102 conform to mattress 104. Elastic lining 112 may be made from materials such as rubber or polyester fibers, ensuring that mattress cover 102 stays in place even without fully tightening and cinching cord 108.

At each of the four corners of mattress cover 102, single-channel lining 106 terminates, exposing section 110 of cord 108. Exposed section 110 may traverse the corners of mattress 104, extending diagonally across each corner. This configuration ensures that mattress cover 102 is securely anchored to mattress 104, preventing slippage, particularly at the corners where traditional covers often fail. Exposed section 110 of cord 108 can be adjusted to various degrees of tension depending on mattress size and shape.

Cord 108 is configured to exit single-channel lining 106 through first intermediate opening 116, is threaded through cinch 120, loops around, and passes back through cinch 120 before re-entering single-channel lining 106 at second intermediate opening 118. This creates loop 122, allowing easy adjustment of the tension of cord 108. Cinch 120 may be a wheeled cord lock, spring-loaded cord lock, friction-based clamp, or other cinching mechanism, depending on user preference and intended use. In an alternative embodiment, cord 108 is not configured as a continuous loop but instead has two free ends threaded through cinch 120, allowing greater flexibility in adjusting the tension. Each of the two free ends may include cord end clasps, cord end crimps, heat shrink tubing, or other types of cord ends to prevent cord ends from passing through cinch 120.

Mattress cover 102 is designed to accommodate a wide range of mattress sizes and shapes, from thin futons to thick pillow-top mattresses. The combination of elastic lining 112 and adjustable cord 108 ensures a snug fit to even non-standard mattress sizes. Exposed sections 110 of cord 108 at the corners further enhance the cover's versatility, allowing mattress cover 102 to adapt to both square and rounded mattress corners.

Each component of mattress cover 102, including the fabric body, single-channel lining 106, cord 108, elastic lining 112, and cinch 120, can be made from various materials depending on desired properties of mattress cover 102. Fabric body of mattress cover 102 may be chosen for softness, durability, or breathability, while single-channel lining 106 may be selected for low friction and durability. Cord 108 must balance flexibility with strength, and elastic lining 112 should maintain elasticity over time. Cinch 120 must be durable enough for repeated use, with some embodiments featuring a non-slip coating to enhance grip on cord 108.

Alternative cinching mechanisms may be employed, such as a toggle or button mechanism, allowing cord 108 to be looped around and secured with a button or toggle. In another embodiment, a hook-and-loop fastener system may be used, where cord 108 is secured by wrapping it around a hook or loop attached to mattress cover 102. Cord 108 may also simply be tied in place without the need for an additional mechanism. These variations allow mattress cover 102 to be tailored to different user preferences, enhancing versatility.

Figure 2:
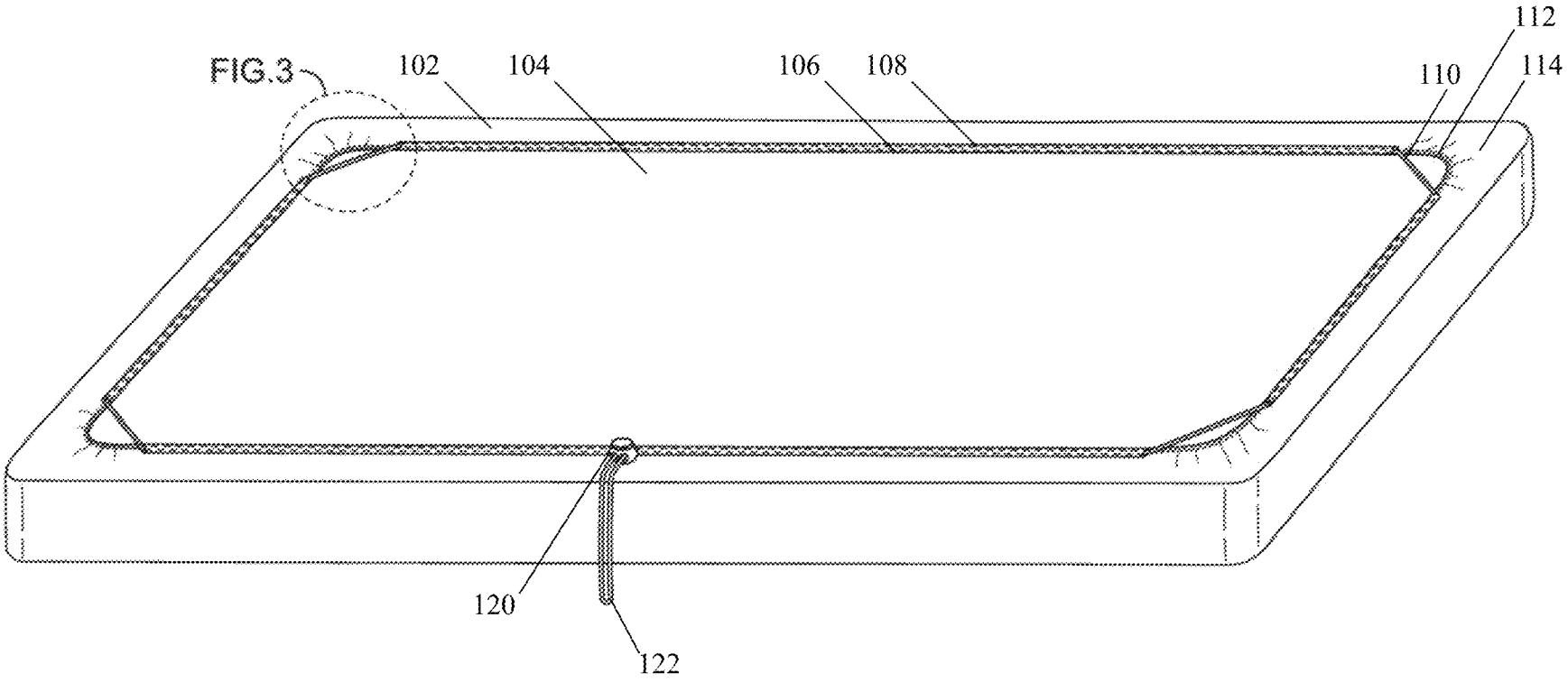
FIG. 2 depicts an illustrative mattress cover in a cinched configuration according to an embodiment of the present disclosure.

FIG. 2 depicts an illustrative mattress cover in a cinched configuration according to an embodiment of the present disclosure. This configuration demonstrates how cord 108, when pulled through cinch 120, effectively draws mattress cover 102 close to the surface of mattress 104, ensuring a secure fit that minimizes slippage and enhances stability during use.

In the cinched configuration, cord 108 has been tightened within single-channel lining 106, reducing excess fabric along the perimeter of mattress cover 102. The tightening action of cord 108 draws the edges of mattress cover 102 snugly around mattress 104, causing elastic lining 112 to stretch and conform closely to the mattress contours. This interaction between cord 108 and elastic lining 112 creates a firm, tailored fit that adjusts to various mattress dimensions, ensuring that mattress cover 102 remains securely positioned even during movement.

A key aspect of this configuration is the manner in which cord 108 is exposed at the corners of mattress cover 102. As shown, exposed section 110 of cord 108 extends diagonally across each corner of mattress 104, effectively engaging the corners to prevent mattress cover 102 from shifting. The exposed cord sections create additional tension at the corners, where traditional covers often experience the most slippage. This ensures that the corners of mattress cover 102 are anchored firmly to mattress 104, providing enhanced stability.

In this cinched state, cord 108 is pulled taut through cinch 120, creating loop 122 that allows the user to lock in the desired tension. Cinch 120 secures cord 108, preventing the cord from loosening and maintaining consistent tension around the entire perimeter of mattress cover 102.

Once cinched, mattress cover 102 offers enhanced durability and security. Cord 108, made from resilient materials like nylon or polyester, maintains integrity even after repeated adjustments. Cinch 120, designed to hold cord 108 firmly in place, is constructed from robust materials that can withstand significant tension without slipping or degrading.

Figure 3:
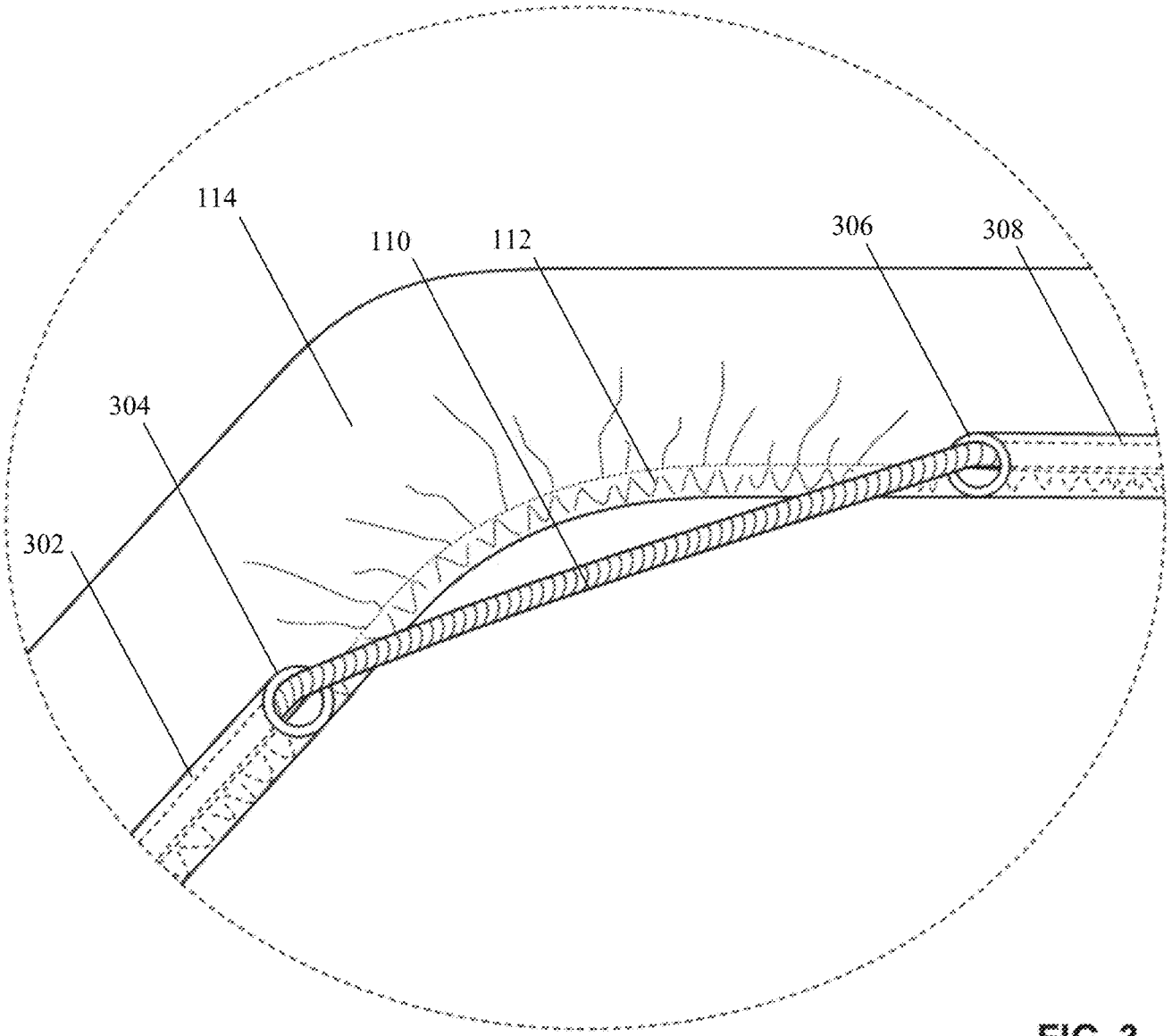
FIG. 3 depicts an illustrative corner of a mattress cover in a cinched configuration according to an embodiment of the present disclosure.

FIG. 3 depicts an illustrative corner of a mattress cover in a cinched configuration according to an embodiment of the present disclosure. FIG. 3 may include first single-channel lining 302 and second single-channel lining 308, which run along adjacent edges of mattress cover 102 and terminate near corner 114. As depicted, first single-channel lining 302 and second single-channel lining 308 terminate at first channel opening 304 and second channel opening 306, respectively, allowing cord 108 to exit from and re-enter the respective linings, resulting in exposed section 110 of the cord traversing mattress 104 at corner 114.

First single-channel lining 302 and second single-channel lining 308 may be stitched securely into the fabric of mattress cover 102, providing a smooth passage for cord 108 and elastic lining 112 along the perimeter of the cover. These linings may be made from durable materials that minimize friction, such as reinforced fabric or nylon, ensuring the cord moves freely during the cinching process. Elastic lining 112 is also partially housed within these linings, providing initial tension that helps mattress cover 102 conform to the shape of mattress 104.

First channel opening 304 and second channel opening 306 may be strategically placed near corner 114, allowing cord 108 to exit from first single-channel lining 302 and enter second single-channel lining 308, forming exposed section 110. In the embodiment shown, each of these openings may be reinforced with metal eyelets to prevent wear and tear from the cord's movement. The metal eyelets provide durability and a smooth surface for the cord to pass through, reducing friction and extending the life of mattress cover 102. However, alternative configurations for these openings are possible. For instance, the openings may be reinforced with plastic grommets, which offer a lighter-weight option, or may simply be stitched and hemmed, relying on the fabric's strength to hold up over time.

The spacing of each of first channel opening 304 and second channel opening 306 from corner 114 can be adjusted depending on the desired amount of exposed cord 110. In the configuration shown, the openings are placed to create an approximately 45-degree angle for exposed section 110 as it cuts across the corner of mattress 104. This angle may be optimal for many standard mattress sizes, providing sufficient tension at the corner to secure the mattress cover without excessive strain on the fabric or cord. However, different spacing configurations may be employed to create other angles, depending on the specific needs of the mattress being covered. For example, increasing the distance between first channel opening 304 and corner 114 results in a longer exposed section 110 and a shallower angle at first channel opening 304, which may be beneficial non-standard mattresses. Conversely, reducing the spacing between first channel opening and corner 114 may result in a steeper angle and greater securement of the long-edge of mattress 104. The spacing for each of first channel opening 304 and second channel opening 306 from corner 114 may also each be increased, maintaining a 45-degree angle at each opening while increasing the length of exposed cord 110.

This detailed view of the corner assembly in FIG. 3 underscores the versatility of the design, allowing for various configurations to accommodate different mattress types, shapes, and user preferences. The combination of exposed cord 110, opening spacing, and optional reinforcements for first channel opening 304 and second channel opening 306 ensures that mattress cover 102 provides a secure, customized fit, enhancing its functionality and durability.

The specification and drawings are, accordingly, to be regarded in an illustrative rather than a restrictive sense. It will, however, be evident that various modifications and changes may be made thereunto without departing from the broader spirit and scope of the disclosure as set forth in the claims.

Other variations are within the spirit of the present disclosure. Thus, while the disclosed techniques are susceptible to various modifications and alternative constructions, certain illustrated embodiments thereof are shown in the drawings and have been described above in detail. It should be understood, however, that there is no intention to limit the disclosure to the specific form or forms disclosed, but on the contrary, the intention is to cover all modifications, alternative constructions, and equivalents falling within the spirit and scope of the disclosure, as defined in the appended claims.

The use of the terms "a" and "an" and "the" and similar referents in the context of describing the disclosed embodiments (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the disclosure and does not pose a limitation on the scope of the disclosure unless otherwise claimed. No language in the specification should be construed as indicating any non-claimed element as essential to the practice of the disclosure.

Disjunctive language such as the phrase "at least one of X, Y, or Z," unless specifically stated otherwise, is intended to be understood within the context as used in general to present that an item, term, etc., may be either X, Y, or Z, or any combination thereof (e.g., X, Y, and/or Z). Thus, such disjunctive language is not generally intended to, and should not, imply that certain embodiments require at least one of X, at least one of Y, or at least one of Z to each be present Although the present disclosure and its advantages have been described in detail, it should be understood that various changes, substitutions and alterations can be made herein without departing from the technology of the disclosure as defined by the appended claims. For example, relational terms, such as "above" and "below" and/or "inside" and "outside" are used with respect to a specific device. Of course, if the device is inverted, above becomes below, and vice versa. Additionally, if oriented sideways, above and below may refer to sides of a device. Further, reference to "first" or "second" instances of a feature, element, or device does not indicate that one device comes before or after the other listed device. Reference to first and/or second devices merely serves to distinguish one device that may be similar or similarly referenced with respect to another device.

Moreover, the scope of the present application is not intended to be limited to the particular configurations of the process, machine, manufacture, composition of matter, means, methods and steps described in the specification. As one of ordinary skill in the art will readily appreciate from the disclosure, processes, machines, manufacture, compositions of matter, means, methods, or steps, presently existing or later to be developed that perform substantially the same function or achieve substantially the same result as the corresponding configurations described herein may be utilized according to the present disclosure. Accordingly, the appended claims are intended to include within their scope such processes, machines, manufacture, compositions of matter, means, methods, or steps.

The description of the disclosure is provided to enable any person skilled in the art to make or use the disclosure. Various modifications to the disclosure will be readily apparent to those reasonably skilled in the art, and the generic principles defined herein may be applied to other variations without departing from the spirit or scope of the disclosure. Thus, the present disclosure is not intended to be limited to the examples and designs described herein but is to be accorded the widest scope consistent with the principles and novel features disclosed herein. Accordingly, the disclosure is not to be limited by the examples presented herein, but is envisioned as encompassing the scope described in the appended claims and the full range of equivalents of the appended claims.

What is claimed is:

1. A mattress cover configured to cover a mattress, comprising:

a fabric body;

an elastic lining extending along an inner perimeter of the fabric body; and a cord housed within the elastic lining and running along a portion of the inner perimeter of the fabric body;

wherein the inner perimeter comprises a first edge, a second edge substantially orthogonal to the first edge, and a corner between the first edge and the second edge;

wherein the elastic lining comprises a first single-channel lining along a length of the first edge and terminating at a first opening positioned near the corner, and a second single-channel lining along a length of the second edge and terminating at a second opening positioned near the corner;

wherein the cord is contained within an entirety of the first single-channel lining, exits the first single-channel lining via the first opening, enters the second single-channel lining via the second opening, and is contained with an entirety of the second single-channel lining such that a portion of the cord is exposed across the corner; and wherein, when the mattress cover is installed on the mattress, the exposed portion of the cord is located at an underside of the mattress, is configured to be in direct contact with the underside of the mattress, and is configured to extend diagonally across a corresponding corner of a bottom surface of the mattress.

2. The mattress cover of claim 1, wherein the cord is configured to be tightened to adjust tension around the inner perimeter of the mattress cover.

3. The mattress cover of claim 1, wherein a spacing between the first opening and the second opening determines a length of the exposed portion of the cord across the corner of the inner perimeter.

4. The mattress cover of claim 3, wherein the first opening and the second opening are positioned to create an approximately 45-degree angle for the cord across the corner of the inner perimeter.

5. The mattress cover of claim 3, wherein the first opening is positioned at a first distance from the corner of the inner perimeter, the second opening is positioned at a second distance from the corner of the inner perimeter, and the first distance is different from the second distance.

6. The mattress cover of claim 1, wherein the first opening and the second opening are reinforced with eyelets.

7. The mattress cover of claim 6, wherein the eyelets are composed of metal or plastic.

8. The mattress cover of claim 1, wherein the cord is composed of a flexible, durable material selected from the group consisting of nylon, polyester, and an elastic polymer.

9. The mattress cover of claim 1, wherein the elastic lining is configured to provide initial tension around the inner perimeter of the fabric body.

10. The mattress cover of claim 1, further comprising a cinching mechanism configured to tighten the cord around the inner perimeter of the mattress cover.

11. The mattress cover of claim 10, wherein the cinching mechanism comprises a cord lock or a friction-based clamp.

12. The mattress cover of claim 11, wherein the cord forms a continuous loop around the inner perimeter of the mattress cover.

13. The mattress cover of claim 12, wherein the cord passes from the elastic lining through a first intermediate opening, passes through the cinching mechanism, and re-enters the elastic lining through a second intermediate opening.

14. The mattress cover of claim 13, wherein the cinching mechanism is configured to lock the cord in a tightened position.

15. The mattress cover of claim 1, wherein the cord comprises two free ends threaded through a cinch at a straight edge of the elastic lining.

16. The mattress cover of claim 15, wherein each of the free ends comprises a cord end clasp configured to prevent each of the free ends from passing through the cinch.

* * * * *